US006363545B1

(12) United States Patent
Nowosad

(10) Patent No.: US 6,363,545 B1
(45) Date of Patent: Apr. 2, 2002

(54) BATH SYSTEM, NOTABLY FOR PHYSICALLY HANDICAPPED PERSONS

(75) Inventor: Harold Nowosad, Spaichingen (DE)

(73) Assignee: Oswald Nowosad (DE)

( * ) Notice: Subject to any disclaimer, the term of this patent is extended or adjusted under 35 U.S.C. 154(b) by 0 days.

(21) Appl. No.: 09/762,818

(22) PCT Filed: Aug. 6, 1999

(86) PCT No.: PCT/EP99/05688

§ 371 Date: Feb. 12, 2001

§ 102(e) Date: Feb. 12, 2001

(87) PCT Pub. No.: WO00/09062

PCT Pub. Date: Feb. 24, 2000

(30) Foreign Application Priority Data

Aug. 10, 1998 (DE) ..... 198 36 037

(51) Int. Cl.[7] ..... A47K 3/02

(52) U.S. Cl. ..... 4/566.1; 4/564.1; 4/565.1; 4/560.1

(58) Field of Search ..... 4/564.1, 565.1, 4/566.1, 495, 560.1

(56) References Cited

U.S. PATENT DOCUMENTS 2,133,587 A * 10/1938 Stark
2,788,527 A * 4/1957 Steven
3,780,385 A * 12/1973 Dunn
3,801,995 A * 4/1974 Adamson
5,341,820 A * 8/1994 Hammett
6,055,685 A * 5/2000 Norton et al.
6,195,812 B1 * 3/2001 McRobert

FOREIGN PATENT DOCUMENTS

WO WO 88/07346 * 10/1988

* cited by examiner

*Primary Examiner*—Gregory L. Huson
*Assistant Examiner*—Khoa D. Huynh
(74) *Attorney, Agent, or Firm*—Pendorf & Cutliff

(57) ABSTRACT

The invention relates to a bath system comprising a bath tub (74) which can be filled with bath water and a lifting surface (16for raising and lowering a person (18) situated in said bath tub (74). For greater ease of use by physically handicapped persons the lifting surface is embodied by a flexible lifting mat (16) which in a pressure-tight manner covers an upper tub opening (14) of a supporting tub (12) which can be subjected to an operating fluid (22). By changing the volume of operating fluid in the supporting tub (12) the lifting mat can be raised and lowered such that it can serve as bath tub (74).

20 Claims, 4 Drawing Sheets

BATH SYSTEM, NOTABLY FOR PHYSICALLY HANDICAPPED PERSONS

BACKGROUND OF THE INVENTION

1. Field of the Invention

The invention concerns a bathing system, particularly for physically handicapped persons, including a bathtub that can be filled with bath water and a lifting surface for raising and lowering a person situated in the bathtub.

2. Description of the Related Art

Bathing systems of this type are intended to facilitate bathing above all for those persons who, due to their physical handicaps, are not in a condition to step over the rim of a conventional bathtub. Therein it is known to provide a rigid lift panel as the lift surface, which is moveable via a hydraulic actuated telescoping cylinder. This system can, in certain cases, be incorporated as a construction component in a bathtub. Herein it has however been discovered, that a rigid lifting plate is ergonomically not sufficiently accommodating, which is particularly considered to be of disadvantage in the case of patients whose injuries make it difficult to lie down, and which could, in the case of epileptic seizures, lead to injuries. In addition, there the substantial construction cost for the lifting device, and this, in addition to the intimidating technical construction, leads to psychological reluctance for utilization by patients.

SUMMARY OF THE INVENTION

Beginning herewith it is the task of the present invention to improve bathing systems of the above-described type in such a manner, that a patient-friendly use is made possible with simplified means.

The invention is based on the concept of designing the lift surface to serve dual functions as both a lift device and as a bathing cradle or basin conforming to the body. This is inventively achieved thereby, that the lift surface is formed by a flexible lifting mat which covers over, in pressure tight manner, the upwardly directed tub opening of a support tub, which lifting mat can be acted upon by a working fluid, and which can be raised or lowered as a bath basin in response to a change in volume of the working fluid in the support tub. The patient is ergonomically supported therewith, and the lift movement is made possible without a lifting mechanism which would be liable to becoming soiled in the submerged area.

According to a particularly preferred embodiment of the invention a lift mat is constructed to be rubber elastically flexible, such that during lowering it deforms and conforms to the body contour of the person and forms a cradle or basin optimally conforming in its dimensions to the person, and can be filled with bath water.

In order to reduce the stretch expansion in the area of the bathing person and to support the person in a more defined manner, it is preferred to re-enforce the lift mat in certain areas using a stiffening element.

The use and also cleaning is thereby further facilitated, in that the lift mat in an upper position fits evenly over the bathtub opening, or preferably with an outwardly convex curvature.

It is further of advantage, when the lift mat can support the person under its own tension, and can be lowered by pumping out some of the work fluid situated within the support tub. Therewith an unintended lowering of the person is avoided and the volume of the bath cradle is exactly adjustable, while the weight of the person contributes only to influencing the tailored deformation of the cradle.

In order to achieve the necessary flexibility, the lift mat is preferably constructed of a silicon material, preferably of silicon rubber, or of rubber or a rubber-elastic flexible elastomer.

In order to facilitate the operation or as the case may be the assembly of the lift mat, it is of advantage, when the lift mat in the area of its outer rim includes a circumscribing retaining frame.

In accordance with one concrete embodiment, the lift mat is connected pressure-tight with the rim bordering the opening of the support tub. For this, the rim of the support tub can exhibit a profile groove and the lift mat can exhibit an edge curvature held form-fittingly in the profile groove, wherein a further edge strip of the lift mat bordering the curved edge circumscribes in pressure tight manner a projecting lip of the profile groove.

Preferably the support tub exhibits a bath water overflow rim circumscribing the tub opening, which connects with an overflow discharge channel. Thereby the bath water flows off by itself during lifting of the lift mat, without requiring any special fittings or valves therefore. Alternatively or in addition thereto it is also possible that the lift mat, preferably in its central area, has a discharge opening closed off tightly by a closure piece, via which the used water can flow off under the influence of gravity.

In a constructionally particularly simple embodiment it is envisioned that the working fluid is air, and that a blower is provided for conveying air between the support tub space and the surrounding atmosphere. Therein the blower device can be formed by two blower units provided in series in a conveyor channel which channel connects the support tub space with the ambient environment, which blower units work in opposition in different conveyor directions, in order to raise the lift mat or to lower it.

In order to make possible an economically particularly advantageous mode of operation, a storage container for working fluid is provided, and a conveyor system is provided for selective conveyance of the work fluid in a closed circuit between the storage container and the support tub. Therein it is advantageous when the work fluid is a work liquid, preferably water, and the conveyor system is a liquid pump, preferably an impeller pump for conveying the work liquid. The pump movement of work liquid can be controlled thereby, that the conveyor system includes at least one directional valve for changing the direction of the flow path of the work fluid between the storage container and the support tub. For simplification of operation it is further advantageous when the conveyor system includes a control device for controlling the work fluid conveyance and operable by a person situated upon the lift mat.

In a particularly compact design, the wall of the support tub separates the support tub space, which is acted upon by the work fluid, from the storage container. A further improvement also with respect to design can be achieved thereby, that the support tub, the storage container and the conveyor are provided in a common tub housing. Therein it is advantageous, when the tub housing and the support tub are formed as a one-piece molded plastic piece, preferably of polyethylene.

For further improvement of the user friendliness, a heating device for heating the work fluid is provided, preferably in the form of a heating mat which can be introduced in the support tub.

BRIEF DESCRIPTION OF THE DRAWINGS

In the following the invention will be described in greater detail on the basis of the illustrative embodiment shown in schematic manner in the figures. There is shown FIG. 1 a bathing device with a lift mat for forming a bathtub, in its raised position in vertical longitudinal section.

DETAILED DESCRIPTION OF THE INVENTION

Figure 1:
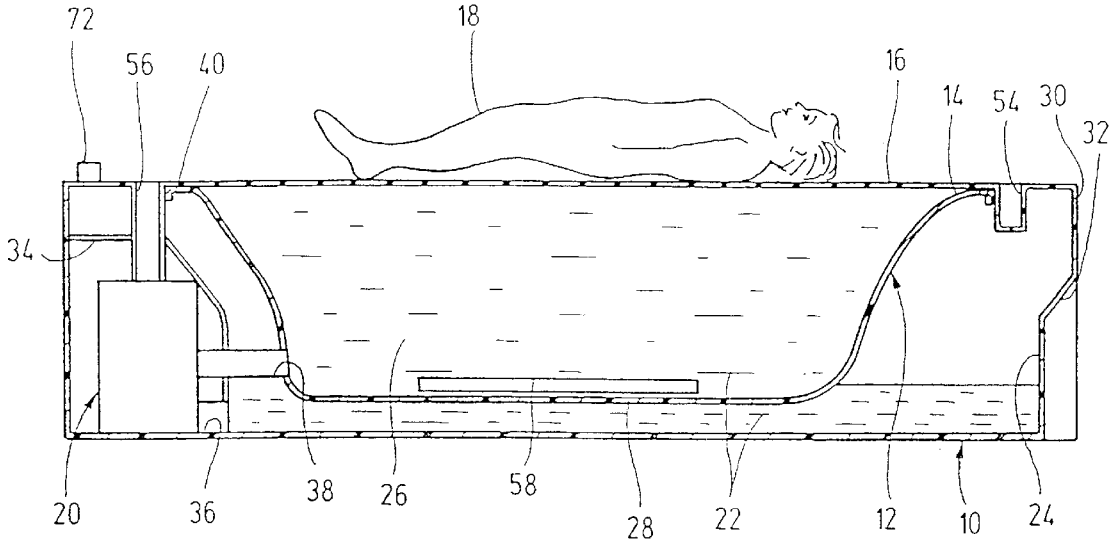

The bathing system shown in the drawing is comprised essentially of a support tub 12 provided in a tub housing 10, lift mat 16 spanning over the support tub 12 in the area of its upward facing tub opening 14 for raising and lowering a person 18 in need thereof, and a pumping system 20 for pumping or as the case may be transferring a work fluid 22 between a storage container 24 and a support tub space 26 which support tub space is bordered in pressure tight manner by the support tub and the lift mat.

The tub housing 10 and the support tub 12 are formed as a unitary part of polyethylene using a rotation sintering process. The wall 28 of the support tub 12 thereby separates the support tub space 26 from the storage container 24 bordered towards the outside by the tub housing 10. The tub housing 10 exhibits in the area of its side wall 30 a constriction 32 for static stabilization. For transfer pumping of the work fluid 22 a pumping device 20 is provided in one end chamber 34 of the tub housing 10 which pumping device is connected with the storage container 24 and the support tub space 26 via feed pipes 36, 38.

Figure 4:
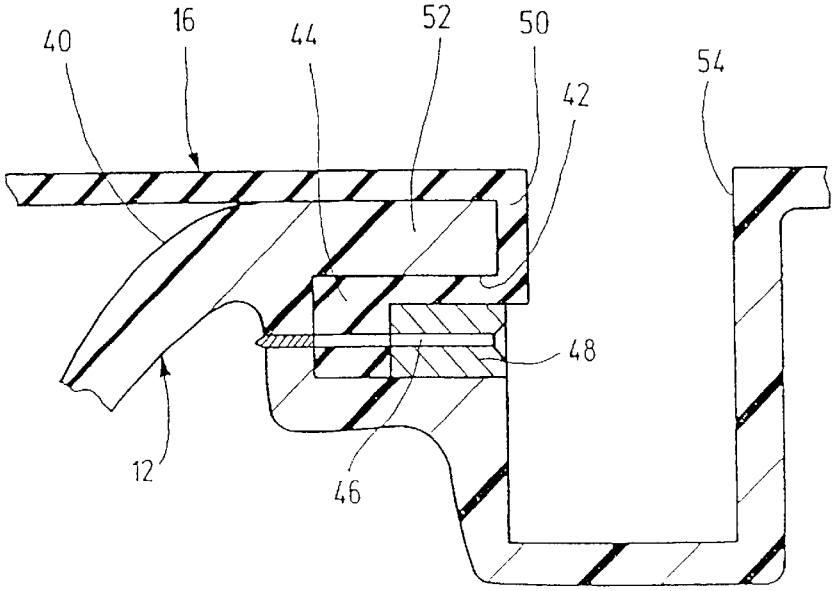
FIG. 4 a sectional enlargement of the representation according to FIG. 3 in the area of the tub rim.

The lift mat 16 is watertight and is comprised of a rubber elastic stretchable silicon rubber. This is tightly connected in a pressure tight manner with the edge area 40 of the support tub 12, i.e., in the edge area 40 bordering the tub opening 14. As shown in particular in FIG. 4, the edge area 40 for this is provided on its lower side with a horizontally outwards directed profile groove 42, in which an edge curvature or arch 44 of the lift mat 16 is form-fittingly anchorable via connecting means (screws 46, retaining bands 48). Thereby an edge strip 50 of the lift mat 16 adjacent to the edge curvature 44 engages and encompasses the upper projecting lip 52 of the profile groove 42 under tension, whereby a pressure tight connection is ensured. An overflow channel 54 formed in the tub housing 10 surrounds the edge area 40 of the support tub 12 and is in communication with a drainage channel 56. For warming the working fluid 22 a heat mat 58 is provided on the bottom of the support tub 12.

Figure 5:
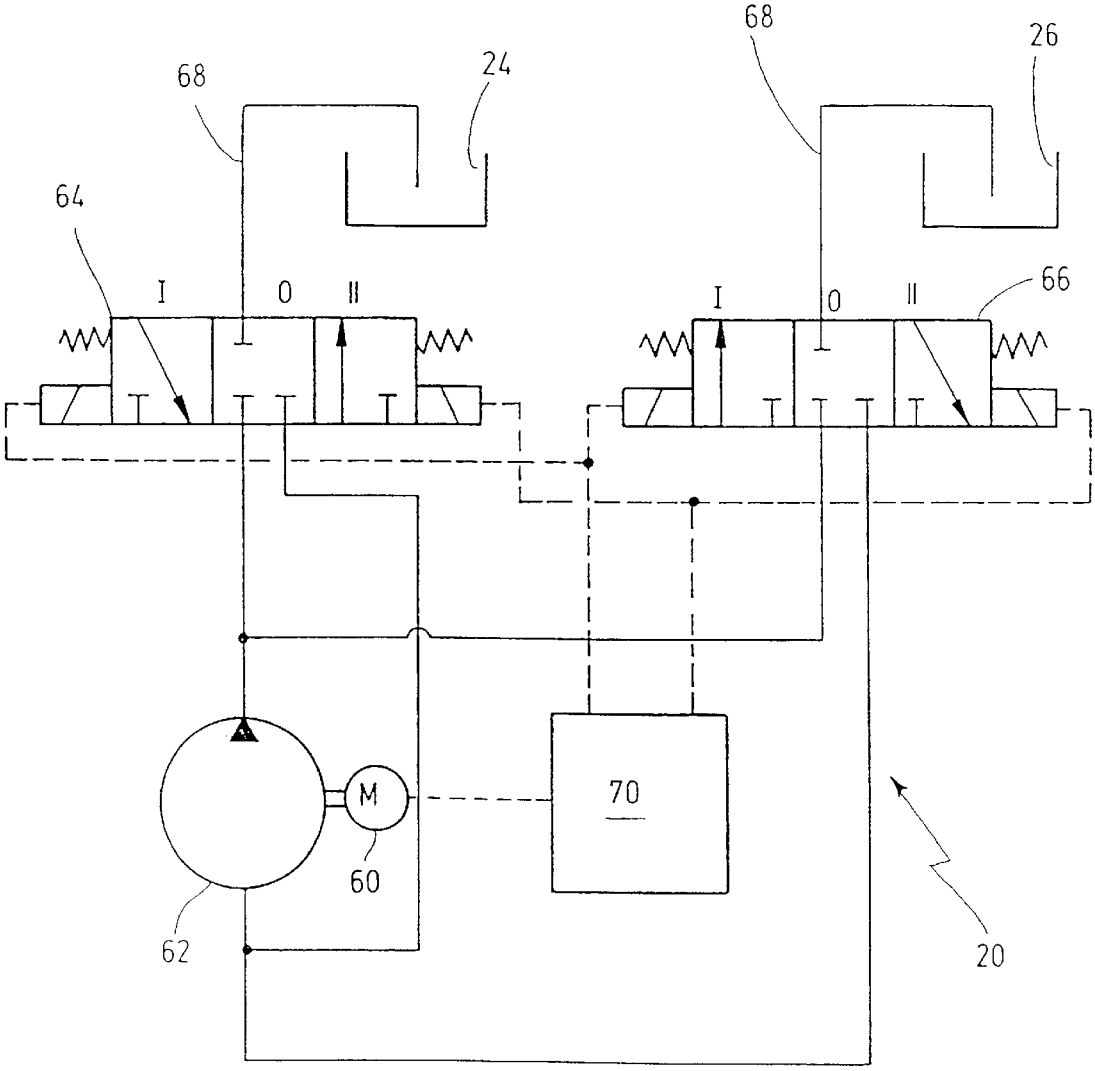
FIG. 5 a block circuit diagram of a hydraulic type conveyance system of the bathing device.

In order to selectively move the work fluid 22, i.e., water, back and forth to thereby cause a lift movement of the lift mat 16, that is, to convey water in the desired amount and direction between the storage container 24 and the support tub or as the case may be the support tub space 26, the conveyor system 20 includes a centrifugal pump 62 driven by a motor 60, as well as 2-way valves 64, 66 (FIG. 5). These 3/3-way valves 64, 66 when in their spring biased starting position 0 block a flow path 68 of the work fluid 22 between the storage container 24 and the support tub space 26, and when in their operating positions I and II make possible a change in the direction of flow. A control device 70 is provided for controlling the pump motor 62 and the valves 64, 66, which includes an input or command unit 72 for operation by the person 18 situated upon the lift mat 16, in certain cases using voice control.

Figure 2:
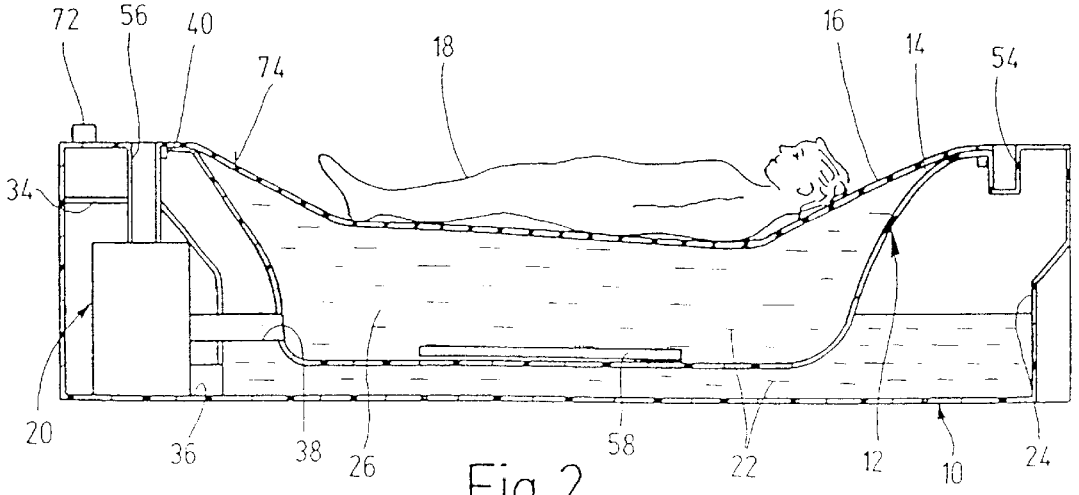
FIG. 2 a representation according to FIG. 1 with stretched lift mat being lowered.
Figure 3:
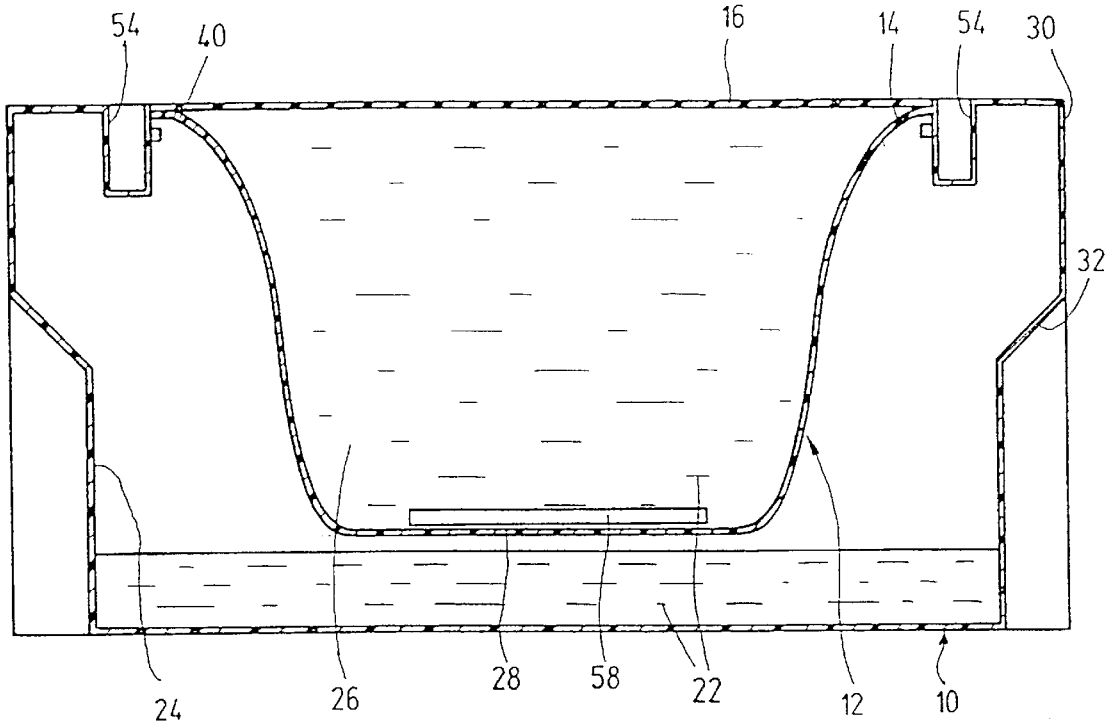
FIG. 3 the bathing device in vertical section perpendicular to FIG. 1.

The lift mat 16 facilitates the use of the bathing system by a physically handicapped person 18. In the raised position shown in FIG. 1 the lift mat 16 is pulled flat and carries the person 18 under tension. By pumping away work fluid 22 out of the support tub space 26 into the storage container 24, the lift mat 16 sinks while stretching and forms thereby a cradle conforming to the body contour of the person 18 or as the case may be forms a bathtub 74 (FIG. 2), which can be filled with bath water (not shown). In order to facilitate leaving this variable volume bathtub, the work fluid 22 is pumped, in the reverse direction, out of the storage container 24 and into the support tub space 26. Thereby the conveyed work fluid volume can even be so selected, that the lift mat 16 bows convexly outwards (not shown), in order to make possible a rolling of the person 18 over the edge 40 and also to allow the bath water to completely run out and drain away via the overflow channel 54.

Figure 6:
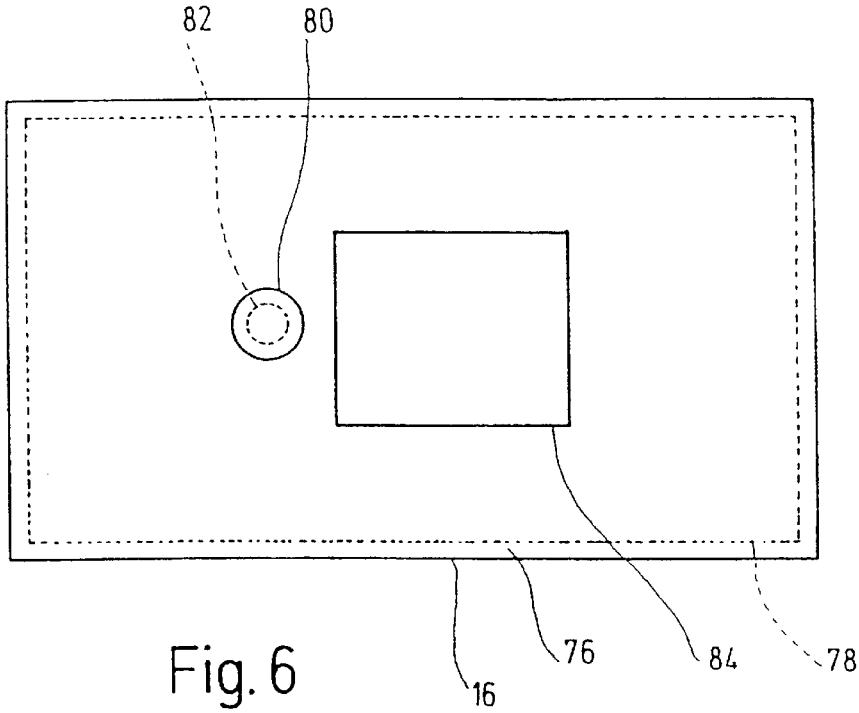
FIG. 6 a further illustrative embodiment of a lift mat viewed from the top.
Figure 7:
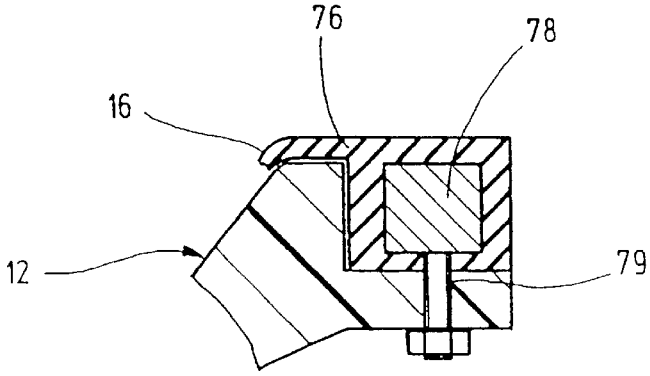
FIG. 7 a lift mat fixed on the tub rim in a representation according to FIG. 4.

In the illustrative embodiment shown in FIG. 6 the lift mat 16 has, in the area of its outer edge 76, a vulcanized-in, circumscribing, stiff retaining frame 78. This is secured to the edge 40 of the support tub 12 via screw connection means 79, whereby the lift mat lies pressure-tight against the support tub rim (FIG. 7). Basically it is also possible to attach the lift mat 16, which is tensioned in the retaining frame 78, upon the edge of a conventional bathtub and to form a tight connection therewith by producing a vacuum in the space between the conventional bathtub and the lift mat 16. As shown in FIG. 6, the lift mat 16 can include an outflow opening 82 tightly closed off by a closure piece 80, via which used water can flow into the thereunder lying tub space and from there can be discharged via a drain. Further, the lift mat 16 can be stiffened, preferably in its central area, by a stiffening element 84, in particular a support plate or a vulcanized-in piece of fabric, in order to provide the bathing person with a stable perch.

Figure 8:
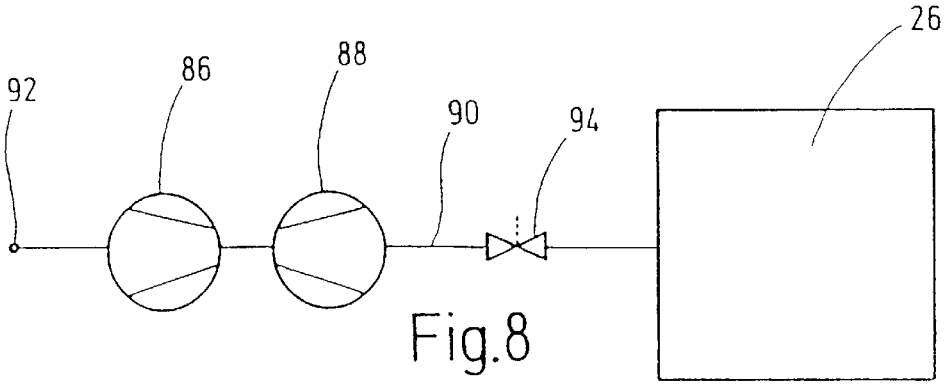
FIG. 8 a block schematic diagram of a pneumatic type bathing system.

A further embodiment envisions that the working fluid is air. In this case the support tub space 26 is in communication with the ambient atmosphere via a bi-directional blower (FIG. 8). The blower is formed by two blower units 86, 88 operating in opposite directions, which are provided in series in a conveyor conduit 90, via which the support tub space 26 is in communication with the atmosphere (outlet point 92). Therein the blower unit 88 in suction mode conveys air out of the support tub space 26 through the switched-off blower unit 86, in order to permit the lift mat 16 to sink against its own inherent pretension. For blocking the conveyance conduit 90, a magnetic valve 94 is provided operable by the bathing person.

In summary the following is to be concluded: The invention relates to a bathing system comprising a bath tub 74 which can be filled with bath water, and a lifting surface 16 for raising and lowering a person 18 situated in said bath tub 74. For greater ease of use by physically handicapped persons the lifting surface is embodied by a flexible lifting mat 16 which covers over an upper tub opening 14 of a supporting tub 12 in a pressure-tight manner, and which lifting mat can be subjected to an operating fluid 22. By changing the volume of operating fluid in the supporting tub 12 the lifting mat can be raised and lowered such that it can serve as a bath tub 74.

What is claimed is:

1. A bathing device including a bathtub (74) which can be filled with bath water and a lift surface (16) for lifting and lowering a person (18) situated in the bathtub (74), wherein the lift surface is formed by a flexible lift mat (16), which covers over a support tub (12) and which can be acted upon by a work fluid (22), which flexible lift mat (16) is in pressure tight engagement with said support tub (12) about the upwardly directed tub opening (14) of the support tub (12), and which flexible lift mat (16) is raiseable and lowerable to function as a bath basin (74) in response to changes in the work fluid volume in the support tub (12), wherein the lift mat (16) spans over the support tub (12) in the area of its upwardly directed tub opening (14), wherein the lift mat (16) is connected in pressure-tight manner around the rim (40) of the support tub (12), wherein the lift mat (16) supports the person (18) under pre-tension and can be lowered by pumping out of work fluid situated in the support tub (12), and wherein the support tub (12) includes an overflow channel (54) surrounding the tub opening (14) of the support tub (12) for bath water, which is in communication with a discharge channel (56).

2. A bathing device according to claim 1, wherein the lift mat (16) is formed of a rubber elastic stretchable material which, during lowering, stretches to form a cradle which can be filled with water and which conforms to the body contours of a person (18) positioned thereon.

3. A bathing device according to claim 1, wherein the lift mat (16) is reinforced in areas by a stiffening element (84) for supporting the person (18).

4. A bathing device according to claim 1, wherein the lift mat (16) in its raised position spans flat over the tub opening (14) or is bowed out in a convex manner.

5. A bathing device according to claim 1, wherein the lift mat (16) is comprised of a stretchable silicon material or rubber, or a stretchable rubbery elastomer.

6. A bathing device according to claim 1, wherein the lift mat (16) in the area of its outer rim (76) is rigidly connected to a circumscribing retaining frame (78).

7. A bathing device according to claim 1, wherein the rim (40) of the support tub (12) exhibits a profile groove (42), and wherein the lift mat (16) exhibits a curved-in edge (44) form fittingly retained in the profile groove (42), and wherein a rim strip (50) bordering the curved-in edge (44) is tensioned around the groove lip (52) of the profile groove (42) in pressure tight manner.

8. A bathing device according to claim 1, wherein the lift mat (16) includes an outflow opening (80) tightly sealable via a closure piece (82).

9. A bathing device according to claim 1, wherein the working fluid is air.

10. A bathing device according to claim 1, further comprising a blower (86, 88) for conveying air as the work fluid between the support tub space (26) and the surrounding atmosphere (92).

11. A bathing device according to claim 10, wherein a blower comprises two blower units (86, 88) provided in series in a conveyor channel (90) which connects the support tub space (26) with the surrounding atmosphere, operating in opposition with opposing directions of conveyance.

12. A bathing device according to claim 1, further comprising a storage container (24) for the work fluid (22) and a conveyor device (20) for selective conveyance of the work fluid (22) in a closed circuit (68) between the storage container (24) and the support tub (12).

13. A bathing device according to claim 12, wherein the work fluid is a liquid (22), and the conveyor device (20) is a centrifugal pump for conveying the work liquid (22).

14. A bathing device according to claim 12, wherein the conveyor device (20) includes at least one directional valve (64, 66) for changing the direction of flow of the work fluid (22) between the storage container (24) and the support tub (12).

15. A bathing device according to claim 12, wherein the conveyor device (20) includes a control device (70) for controlling the conveyance of the work fluid, said control device operable by a person (18) situated upon the lift mat (16).

16. A bathing device according to claim 12, wherein the wall (28) of the support tub (12) separates the support tub space acted upon by the work fluid (22) from the storage container (24).

17. A bathing device according to claim 12, wherein the support tub (12), the storage container (24) and the conveyor means (20) are provided in a common tub housing (10).

18. A bathing device according to claim 17, wherein the tub housing (10) and the support tub (12) are formed as a one-piece plastic part, preferably of polyethylene.

19. A bathing device according to claim 1, further comprising a heating device (58) for warming the work fluid (22).

20. A bathing device as in claim 19, wherein said heating device is a heat mat introduceable in the support tub (12).

* * * * *